US007025012B1

(12) United States Patent
Pecharich

(10) Patent No.: US 7,025,012 B1
(45) Date of Patent: Apr. 11, 2006

(54) BOAT CLEAT AND METHOD OF SECURING A ROPE THERETO

(76) Inventor: Milan Pecharich, 1637 Darien Club Dr., Darien, IL (US) 60561

( * ) Notice: Subject to any disclaimer, the term of this patent is extended or adjusted under 35 U.S.C. 154(b) by 0 days.

(21) Appl. No.: 11/001,439

(22) Filed: Nov. 30, 2004

(51) Int. Cl.
*B63B 21/04* (2006.01)

(52) U.S. Cl. ..... 114/218; 248/74.5

(58) Field of Classification Search ..... 114/218, 114/219; 24/129 R, 130, 135 R; 248/74.5
See application file for complete search history.

(56) References Cited

U.S. PATENT DOCUMENTS

| | | | | |
|---|---|---|---|---|
| 1,010,108 | A * | 11/1911 | Ashworth | 114/218 |
| 3,431,568 | A * | 3/1969 | Brown | 114/218 |
| 4,741,283 | A | 5/1988 | Conner | |
| 5,261,343 | A | 11/1993 | Elterman et al. | |
| 5,634,421 | A | 6/1997 | Velarde | |
| 5,660,133 | A | 8/1997 | Munich | |
| 5,676,508 | A | 10/1997 | Weicht | |
| 5,806,452 | A * | 9/1998 | Benoit | 114/218 |
| 6,009,824 | A | 1/2000 | Ross | |
| 6,094,783 | A | 8/2000 | Parsons | |
| 6,113,328 | A | 9/2000 | Claucherty | |
| 6,152,060 | A | 11/2000 | Steiner | |
| 6,163,936 | A * | 12/2000 | Benoit | 114/218 |
| 6,487,984 | B1 | 12/2002 | Pape et al. | |
| 6,588,355 | B1 | 7/2003 | Whitley, II et al. | |
| 6,604,482 | B1 | 8/2003 | Martello | |
| 6,640,738 | B1 | 11/2003 | Pierce | |
| 6,651,576 | B1 | 11/2003 | Lo | |
| 6,769,375 | B1 * | 8/2004 | Caporella | 114/218 |

* cited by examiner

*Primary Examiner*—Lars A. Olson
(74) *Attorney, Agent, or Firm*—McAndrews, Held & Malloy, Ltd.

(57) ABSTRACT

A cleat for securing a rope includes a main component and a secondary component. The main component has an aperture formed therein and a pair of cleat horns. The secondary component has an aperture that is alignable with the main component aperture. Each of the main component and secondary component has a connectable surface and a mountable surface. The connectable surfaces are adapted to cooperate such that the secondary component is engageable with the main component. The mountable surfaces are adapted to cooperate such that the mountable surfaces secure the cleat to a support when assembled. A rope is secured to the cleat by first securing the cleat to a support, then threading the rope through the aperture, and then tying the rope around the cleat horns.

5 Claims, 8 Drawing Sheets

BOAT CLEAT AND METHOD OF SECURING A ROPE THERETO

FIELD OF THE INVENTION

The present invention relates to device and method for securing ropes. In particular, the present invention relates to a cleat for securing one end of a rope to a boat railing or stanchion, while the other end of the rope has an opposing force applied to its other end, such as by a fender suspended therefrom.

BACKGROUND OF THE INVENTION

Boat pilots often struggle with docking their watercraft, such as a boat, small ship or yacht. A boat can be damaged if its hull impacts a fixed support, such as a wooden pile and/or the metal or wooden portion of a dock. In docking a boat, a pilot can be forced to maneuver the boat into a narrow space between fixed supports while the boat is being rocked by waves and/or currents, or with low visibility due to adverse weather conditions or blind spots.

Boat fenders have been employed in circumstances such as these to aid a boat pilot in maneuvering the boat into position without doing damage to either the dock or the boat hull. Boat fenders are made in a variety of shapes and sizes, but are generally elongated along an axis from which a rope is attached, thereby allowing the fender to be lowered into position and suspended between the boat hull and the adjacent dock. Boat fenders are also manufactured from a variety of materials, including plastics and rubber, and are generally designed to float in case the rope or line suspending the fender breaks. When properly placed, a boat fender cushions impacts between the hull and the dock or piling, preventing damage to both.

Unfortunately, boat fenders can be awkward and difficult to accurately and conveniently position and fix in place once positioned. Pilots and ship crews have tried a variety of techniques for orienting and fixing boat fenders into position, particularly when the boat is moving toward a dock, but these prior techniques are not entirely satisfactory.

One technique for positioning boat fenders involves letting a rope, which is attached at one end to the fender, down over the side of a ship railing until the fender is in the desired position between the boat hull and the dock. Once positioned, the rope at the end opposite the fender is simply knotted and secured around a portion of the railing extending along the periphery of the boat's topside deck. This fender positioning technique has the advantage of involving no special equipment, and for that reason is probably the most common technique for securely suspending a fender from the boat railing.

The foregoing technique has significant disadvantages, however. First, the foregoing technique requires the pilot or crewmember to have the knowledge and ability to tie a sturdy knot. Some crewmembers may not know how to tie such a knot. Other crewmembers may have physical limitations, such as muscle weakness or arthritis, which inhibit the tying of sturdy knots. Second, and perhaps more importantly, even a sturdy knot will not prevent the rope from sliding laterally along a railing. Generally, the coefficients of friction are too low to prevent a knotted rope from being pulled along the railing when a boat hull pinches the boat fender against a dock. As a result, boat fenders can move laterally away from their correct position. This can lead to damage to the boat if the fender is not present to absorb at least some of the impact of the boat against the dock.

A second technique for positioning boat fenders is slightly more complicated than the first technique, and involves a device, usually made of plastic, that is designed to attach to the boat railing. Embodiments of such a device are shown in U.S. Pat. Nos. 6,094,783 and 6,152,060, for a "Rope Clamp" and "Hooker Cleat", respectively. In this second technique, a rope attached at one end to the boat fender is threaded at its other end through the device, which is in turn mounted to the railing.

This second technique has advantages over the first technique in avoiding the inconvenience of having to tie a sturdy knot to secure the rope to the boat railing. But the second technique has the disadvantage of requiring the use of a special device to secure the rope to the boat railing and, perhaps more importantly, the second technique has the same principal disadvantage of the first technique, namely, the rope-securing device is not laterally fixed to the boat railing, and can therefore slide horizontally back and forth when the boat fender is pinched between the boat hull and the dock.

In a third technique involving another rope-securing device, a rope attached to a cleat is threaded through a device designed to attach to a stanchion. Stanchions are the vertical supports that hold up the railing(s) above and around the periphery of the boat's deck. An embodiment of a rope-securing device that is employable in connection with the third technique is described in Munich U.S. Pat. No. 5,660,133. This third technique has the advantage of laterally fixing the position of the boat fender. But the third technique has the disadvantage of allowing the boat fender to be positioned only in certain lateral positions, namely, the positions of the stanchions. Some boats have stanchions spaced closely around the deck, but others have fewer, and it can be difficult or impossible to properly position fenders on such boats. Moreover, devices employable in accordance with the third technique tend to slide vertically or detach after extended use, thereby defeating their intended function to fix the position of a boat fender.

SUMMARY OF THE INVENTION

The present boat cleat overcomes at least some of the shortcomings of conventional boat cleats. In one embodiment, the cleat for securing a rope comprises a main component and a secondary component. The main component has a first end portion with an aperture formed therein and an oppositely disposed second end portion having at least one cleat horn projecting therefrom. The main component has a connectable surface and a mountable surface. The secondary component has a first end portion with an aperture formed therein. The secondary component aperture is alignable with the main component aperture. The secondary component has a connectable surface and a mountable surface. The secondary component connectable surface is adapted to cooperate with the main component connectable surface such that the secondary component is engageable with the main component. The secondary component mountable surface is adapted to cooperate with the main component mountable surface such that the cooperating mountable surfaces secure the cleat to a support when assembled.

In a preferred cleat embodiment, the at least one cleat horn of the main component is a pair of cleat horns. The pair of cleat horns is preferably oppositely projecting. Each of the cleat horns preferably has a bulbed distal end portion.

In a preferred embodiment, one of the main component connectable surface and the secondary component connectable surface has an outwardly projecting portion. The other of the main component connectable surface and the secondary component connectable surface has a reciprocal channel formed therein for receiving the outwardly projecting portion. The outwardly projecting portion is preferably key-shaped and the reciprocal channel is preferably keyway-shaped.

In a preferred embodiment, the main component mountable surface and the secondary component mountable surface cooperate when assembled to frictionally secure the cleat to a support.

The support to which the present cleat structure is securable can be cylindrical and/or tubular. The support can be a horizontally extending rail or a vertically extending stanchion.

In a preferred embodiment, the main component and the secondary component are connected to the support such that the cleat is repositionable along the support.

The main component and the secondary component are preferably joined together by a fastener. The fastener preferably comprises a bolt having a threaded end that is engageable with a cooperating threaded fastening hole formed in one of the main component and the secondary component, such that extending the bolt through the other of the main component and the secondary component, and engaging the bolt within the fastening hole, joins together the main component and the secondary component.

Each of the apertures preferably has a tapered edge or a curved edge.

A method for securing a rope to a cleat includes the steps of:

(a) securing the cleat to a support, the cleat comprising a main component and a secondary component, the main component having an aperture formed in a first end portion thereof and at least one cleat horn projecting from an oppositely disposed second end portion thereof, the main component and the secondary component connectable to frictionally secure the cleat to a support when assembled;

(b) threading the rope through the aperture; and (c) tying the rope around the at least one cleat horn.

In a preferred embodiment of the method, the rope, when tied around the at least one cleat horn, is clenched between the at least one cleat horn and the support. The method preferably further comprises the step of knotting a loose end of the rope.

DETAILED DESCRIPTION OF PREFERRED EMBODIMENT(S)

The present boat cleat is designed for mounting either horizontally to a rail or vertically to a stanchion. Whether horizontally or vertically mounted, the present cleat provides an advantageous means for securing one end of a rope that has an opposing force applied to its other end, such as by a fender suspended from the rope. The present cleat design, when mounted on a rail or stanchion, inhibits lateral and vertical movement of the rope. In one embodiment, the boat cleat quickly and easily mounts with a single fastener, requiring no tying of knots. In addition, the present boat cleat does not require the rope to be threaded through a complicated device. Instead, the rope can simply be passed through the aligned apertures of the main component and secondary components that make up the cleat, and then wrapped around the cleat horn(s). In various embodiments, the present cleat also provides a more attractive alternative to other devices and techniques for positioning boat fenders and the like.

Figure 1:
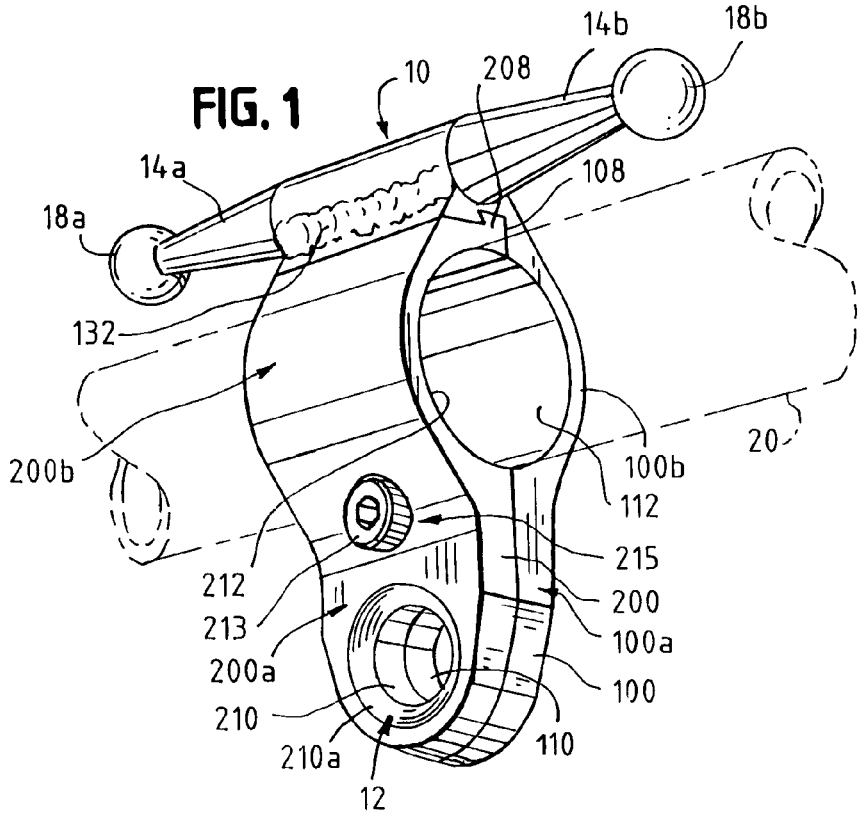
FIG. 1 is a perspective view of an embodiment of the present boat cleat showing its being formed of a main component and a secondary component joined together by a bolt.

Turning first to FIG. 1, an embodiment of boat cleat 10 is formed from two pieces or components held together by a fastener 213. Main component 100 has a first end portion 100*a* with an aperture formed therein that is defined by annular surface 10. Main component 100 also has a connectable surface 108 and a mountable surface 112. Main component 100 has an oppositely disposed second end portion 100*b* with a pair of cleat horns 14*a*, 14*b* projecting therefrom. Each of cleat horns 14*a*, 14*b* has a bulbed end 18*a*, 18*b*, respectively. As shown in FIG. 1, cleat horns are attached to second end portion 100*b* by weld 132. Weld 132 could be polished away or hidden by ornamentation.

As further shown in FIG. 1, secondary component 200 has a first end portion 200*a* with an aperture formed therein that is defined by annular surface 210. The aperture of secondary component 200 is alignable with the aperture of main component 100 to define cleat aperture 12, through which a rope can be threaded. Annular surface 210 preferably has a rounded, curved or tapered edge 210*a* to prevent a rope (not shown in FIG. 1) from fraying or otherwise becoming damaged when sliding through aperture 12. Similarly, annular surface 110 of main component 100 has a rounded, curved or tapered edge (not specifically shown in FIG. 1).

Secondary component 200 has a connectable surface 208 and a mountable surface 212. Secondary component connectable surface 208 cooperates with main component connectable surface 108 such that secondary component 200 is engageable with main component 100. In the embodiment of FIG. 1, connectable surface 108 is a channel or groove (specifically shown as a keyway in FIG. 1). Connectable surface 208 is shown in FIG. 1 as a tongue or key-shaped projection, which is insertable into the keyway of main component 100 to engage components 100 and 200. In their preferred configurations, main component 100 and secondary component 200 are thus removably engaged by a male/female, key/keyway or tongue-and-groove connection.

Like main component 100, secondary component 200 has a mountable surface 212 at the second end portion 200*b*, which is adapted to cooperate with main component mountable surface 112 such that cooperating surfaces 112 and 212 secure cleat 10 to a support (shown in phantom lines as railing 20 in FIG. 1) when assembled.

As further shown in FIG. 1, secondary component 200 has a minor aperture 215 to accommodate a fastener (shown in FIG. 1 as bolt 213) that extends through secondary component 200 toward main component 100. Bolt 213 has a threaded end that is engageable with a cooperating threaded fastening hole (not shown in FIG. 1) formed in main component 100, such that when bolt 213 is extended through aperture 215 in secondary component 200, and bolt 213 is engaged within the threaded fastening hole, main component 100 and secondary component 200 are joined together.

In the embodiment illustrated in FIG. 1, the fastener is a bolt 213 that engages a threaded fastening hole in main component 100. Other suitable fastener configurations could be employed as well. For example, a bolt could be extended through an aperture in main component 100 to engage a threaded fastening hole in secondary component 200. An additional fastener (besides fastener 213) could also be used to hold together main component 100 and secondary component 200.

It will be recognized that the connectable surfaces of main component 100 and secondary component 200 need not cooperate by engaging one another as male/female, key/keyway or tongue-and-groove surface configurations. Other suitable mating configurations could be employed to removably engage main component 100 and secondary component 200.

Figure 2:
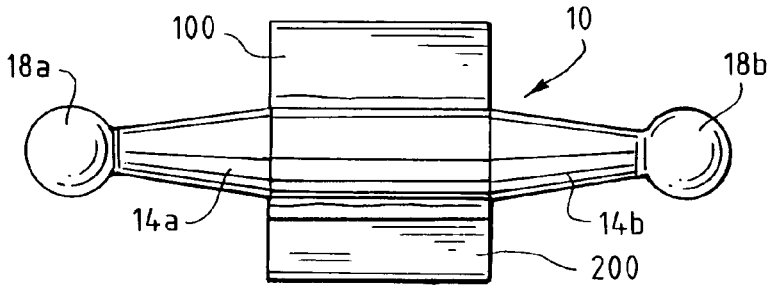
FIG. 2 is a top view of the boat cleat illustrated in FIG. 1.

FIG. 2 is a top view of boat cleat 10 of FIG. 1, showing main component 100, secondary component 200, and the pair of cleat horns 14*a*, 14*b* projecting in opposite directions from the upper end portion of main component 100. Each of cleat horns 14*a*, 14*b* has a bulbed distal end portion 18*a*, 18*b*, respectively.

Figure 3:
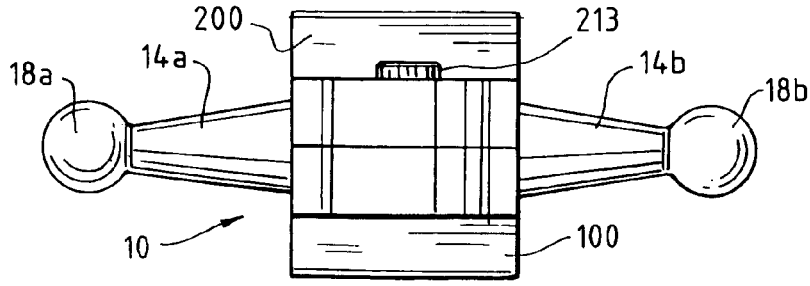
FIG. 3 is a bottom view of the boat cleat illustrated in FIG. 1.

FIG. 3 is a bottom view of boat cleat 10 of FIG. 1, showing main component 100, secondary component 200, the pair of oppositely projecting cleat horns 14*a*, 14*b* (each having a bulbed distal end portion 18*a*, 18*b*, respectively), and threaded fastening bolt 213, which extends through an aperture (not shown in FIG. 3) in secondary component 200, and engages a cooperating threaded fastening hole (not shown in FIG. 3) formed in main component 100.

Figure 4:
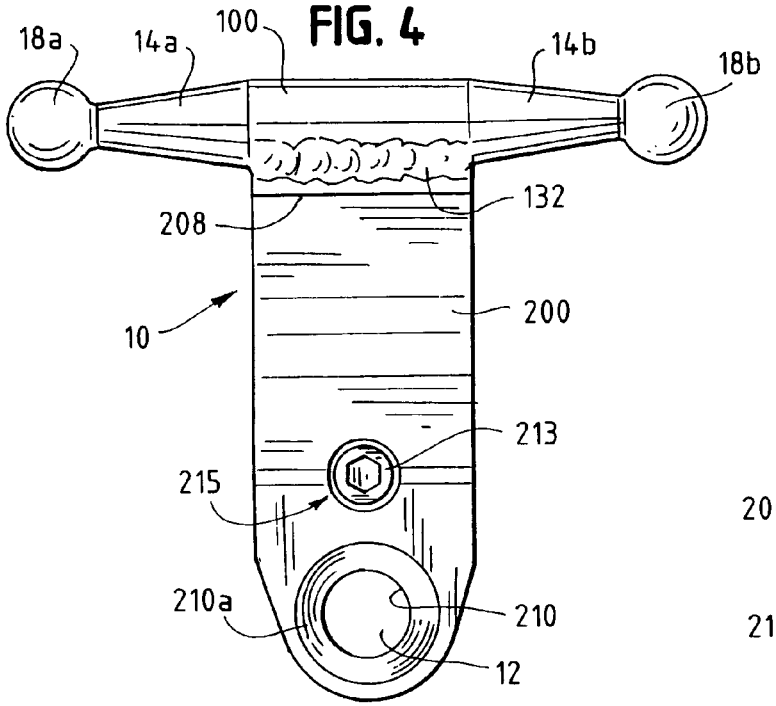
FIG. 4 is a front elevation view of one side of the boat cleat illustrated in FIG. 1.

FIG. 4 is a front view of one side of boat cleat 10 of FIG. 1, showing secondary component 200, and the pair of oppositely projecting cleat horns 14*a*, 14*b* (each having a bulbed distal end portion 18*a*, 18*b*, respectively) attached to the upper portion of main component 100 by weld 132. FIG. 4 also shows threaded fastening bolt 213, which extends through aperture 215 in secondary component 200 and engages a cooperating threaded fastening hole (not shown in FIG. 1) formed in main component 100 (also not shown in FIG. 1). As further shown in FIG. 4, secondary component 200 has an aperture formed therein that is defined by annular surface 210. The aperture of secondary component 200 is alignable with the aperture of the main component (not shown in FIG. 4) to define cleat aperture 12, through which a rope can be threaded. Annular surface 210 has a rounded, curved or tapered edge 210*a* to prevent a rope from fraying or otherwise becoming damaged when sliding through aperture 12.

Figure 5:
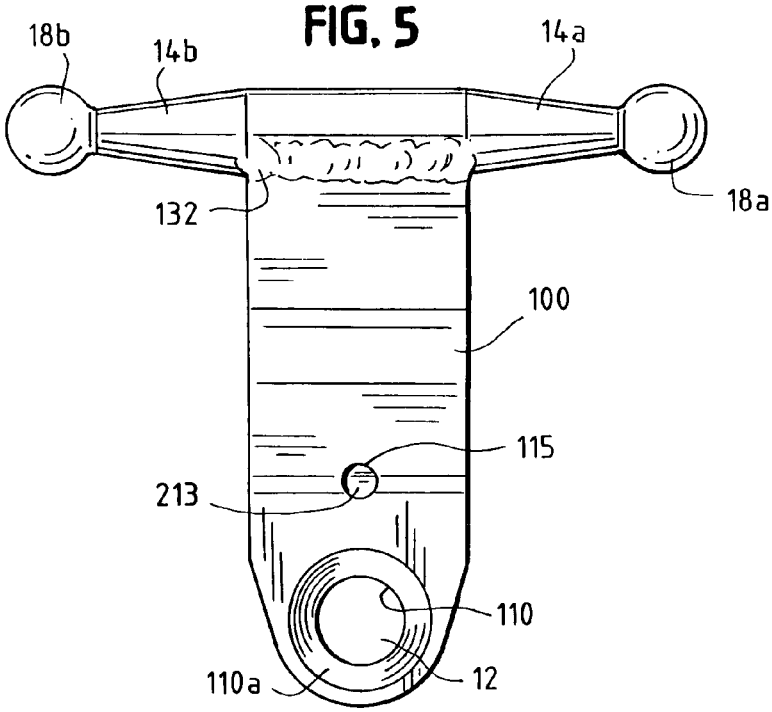
FIG. 5 is a rear elevation view of other side of the boat cleat illustrated in FIG. 4.

FIG. 5 is a rear elevation view of other side of boat cleat 10 illustrated in FIG. 4, showing main component 100, and the pair of oppositely projecting cleat horns 14*a*, 14*b* (each having a bulbed distal end portion 18*a*, 18*b*, respectively) attached to the upper portion of main component 100 by weld 132. FIG. 5 also shows the distal end of threaded fastening bolt 213, which extends through aperture (not shown) in secondary component 200, engaging a cooperating threaded fastening hole 115 formed in main component 100). As further shown in FIG. 5, main component 100 has an aperture formed therein that is defined by annular surface 110. The aperture of main component 100 is alignable with the aperture of the secondary component (not shown in FIG. 5) to define cleat aperture 12, through which a rope can be threaded. Like secondary component annular surface 210 of FIGS. 1 and 4, main component annular surface 110 has a rounded, curved or tapered edge 110*a* to prevent a rope from fraying or otherwise becoming damaged when sliding through aperture 12.

Figure 6:
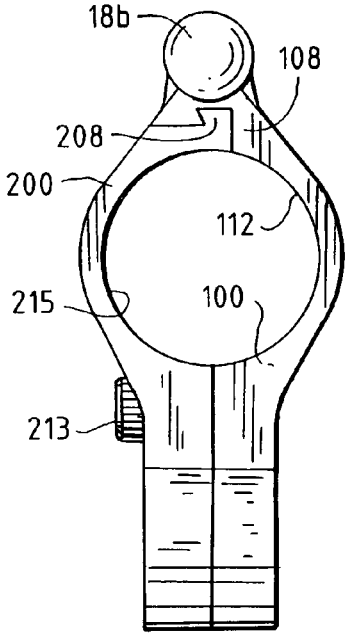
FIG. 6 is a side elevation view of the boat cleat illustrated in FIGS. 4 and 5, showing the main component and secondary component in their assembled configuration and joined together by a bolt.

FIG. 6 is a side of boat cleat 10 illustrated in FIGS. 4 and 5, showing main component 100, secondary component 200, and a cleat horn with bulbed end portion 18*b*. FIG. 6 also shows threaded fastening bolt 213, which extends through an aperture in secondary component 200 and engages a cooperating threaded fastening hole (not shown in FIG. 1) formed in main component 100.

As further shown in FIG. 6, secondary component 200 has a connectable surface 208, which cooperates with a connectable surface 108 of main component 100. In the illustrated embodiment, connectable surface 108 is keyway-shaped, as also illustrated in FIG. 1, and connectable surface 208 is a key-shaped projection. As shown in FIG. 6, key-shaped connectable surface 208 is insertable into keyway-shaped connectable surface 108 to engage main component 100 and secondary component 200.

Figure 7:
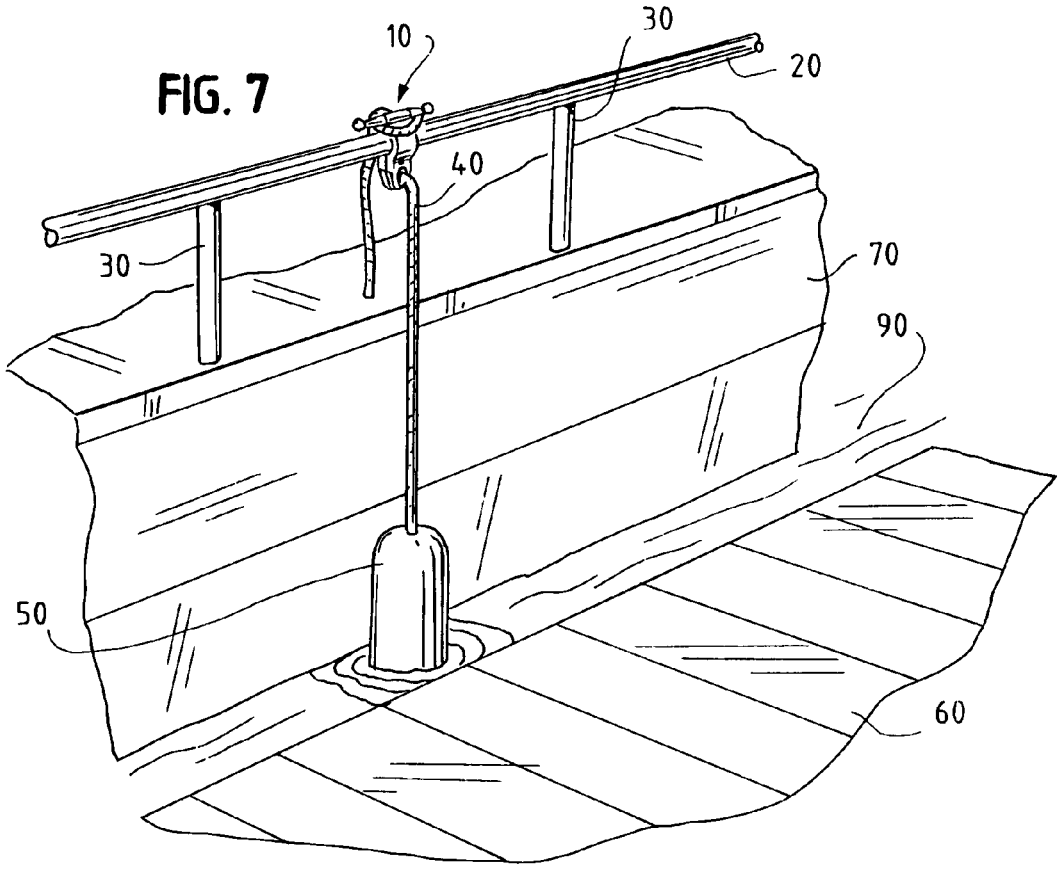
FIG. 7 is a perspective view of the boat cleat of FIG. 1 secured to a rail and having a boat fender suspended from the cleat by a rope to protect the boat from impacting the adjacent dock.

As further shown in FIG. 6, main component 100 has an inner mountable surface 112, which is adapted to cooperate with inner mountable surface 212 of secondary component 200 to secure cleat 10 to a support (not shown in FIG. 6) when assembled FIGS. 7–14 shows boat cleat 10 in various stages of use. FIG. 7 shows boat cleat 10 secured to a horizontally extending rail 20 and having a boat fender 50 suspended from cleat 10 by a rope 40 to protect hull 70 of boat 80, which is floating in body of water 90, from impacting the adjacent dock 60. Rail 20 is supported vertically by stanchion 30.

Figure 8:
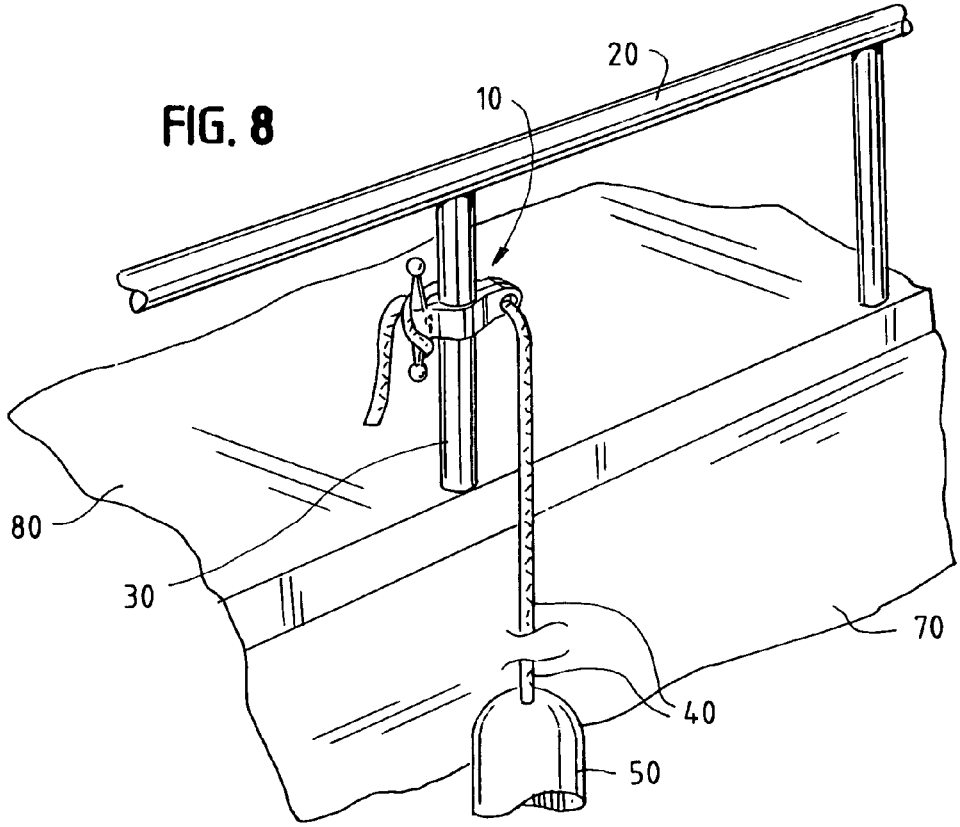
FIG. 8 is a perspective view of the boat cleat of FIG. 1 secured to a stanchion.

Instead of being secured to rail 20, FIG. 8 shows boat cleat 10 secured to a vertically extending stanchion 30 and having a boat fender 50 suspended from cleat 10 by a rope 40 to protect hull 70 of boat 80 from impacting the adjacent dock (not shown in FIG. 8).

Figure 9:
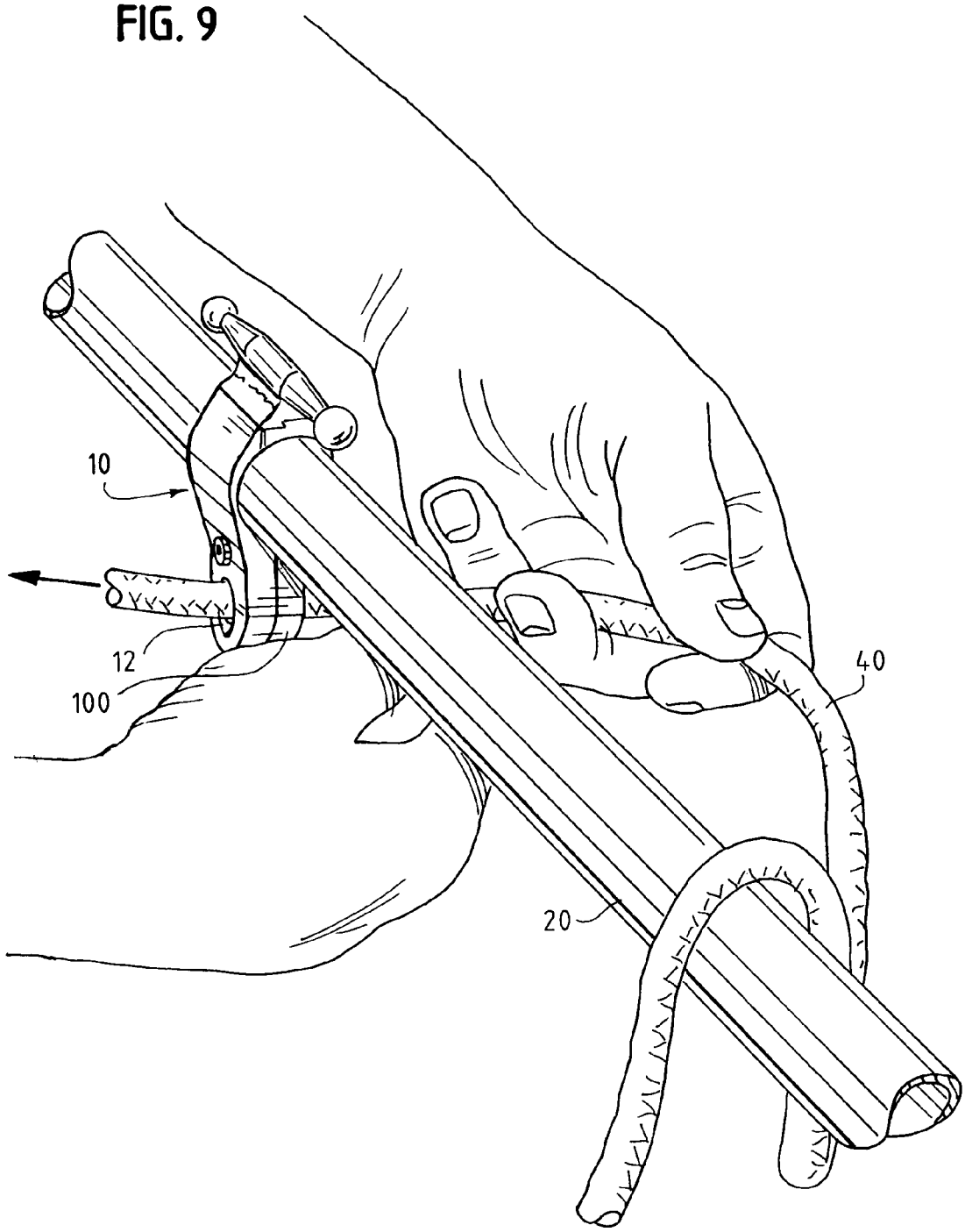
FIG. 9 is a perspective view of a rope being threaded through the aperture of the boat cleat of FIG. 1.
Figure 10:
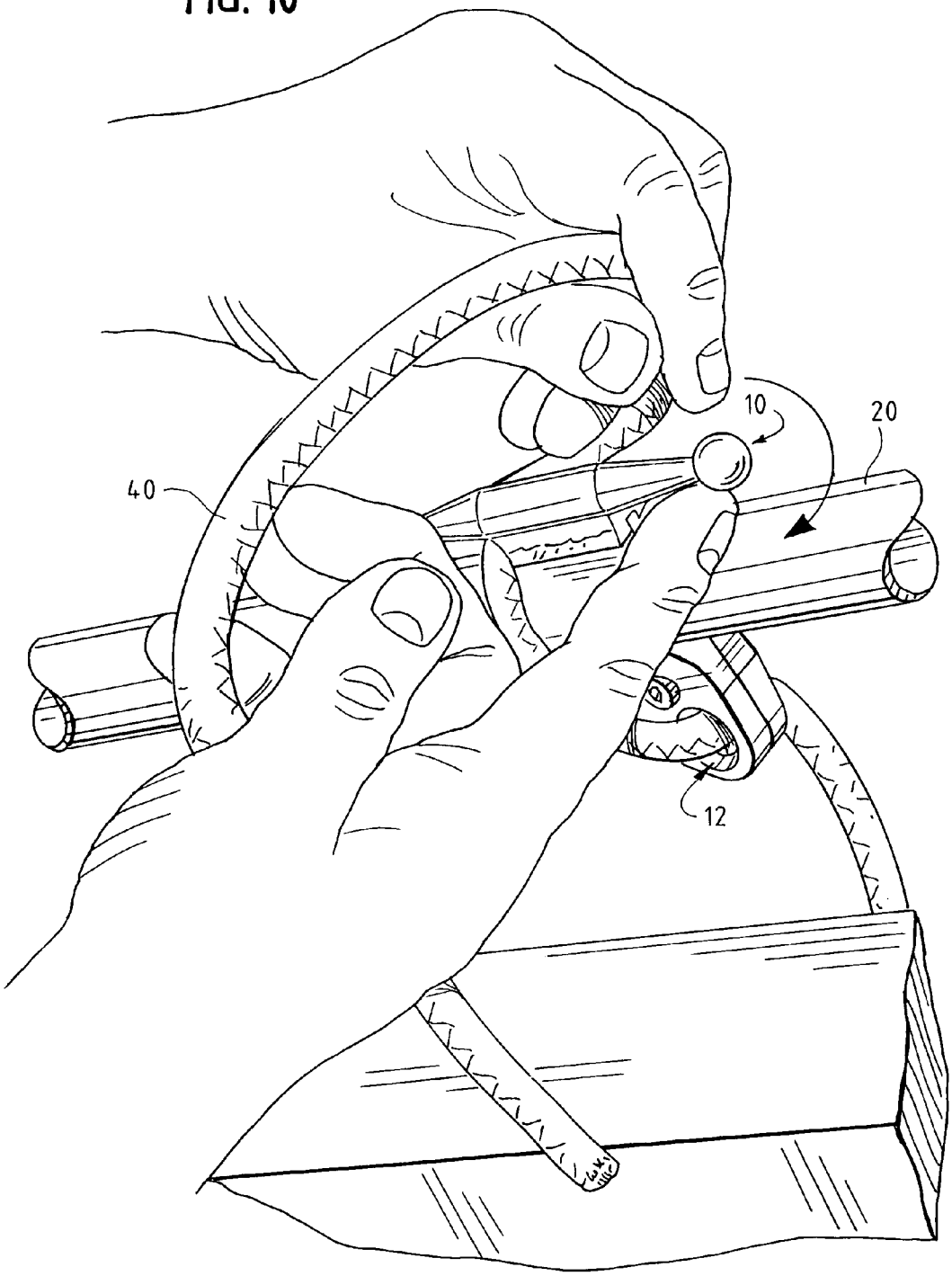
FIG. 10 is a perspective view of the boat cleat of FIG. 1 showing the rope, having been threaded through the cleat aperture as in FIG. 9, in the process of being tied off to the cleat.
Figure 11:
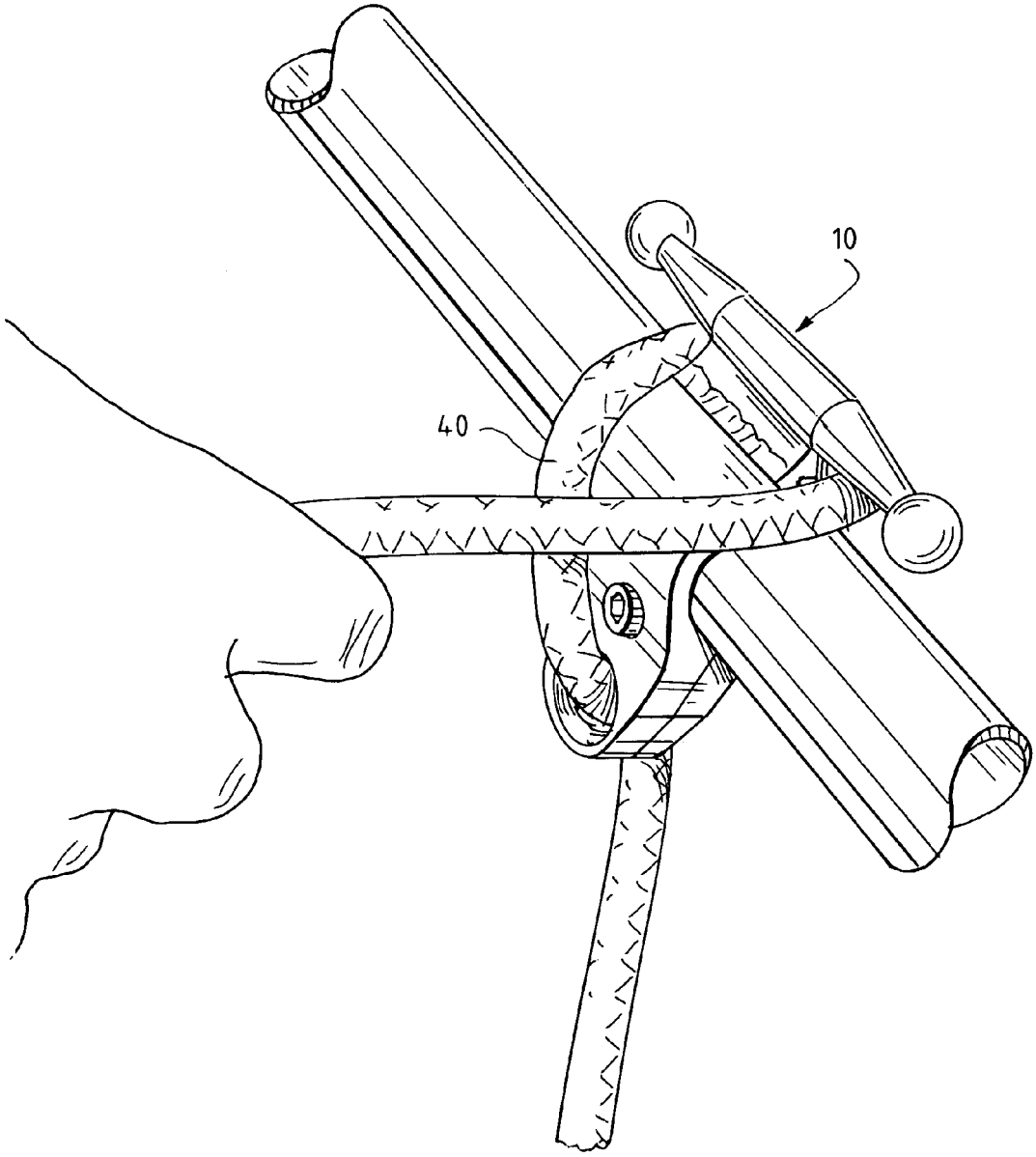
FIG. 11 is a perspective view of the boat cleat of FIG. 1 showing the rope, having been threaded through the cleat aperture and partially tied off as in FIGS. 9 and 10, having been fully tied off to the cleat.
Figure 12:
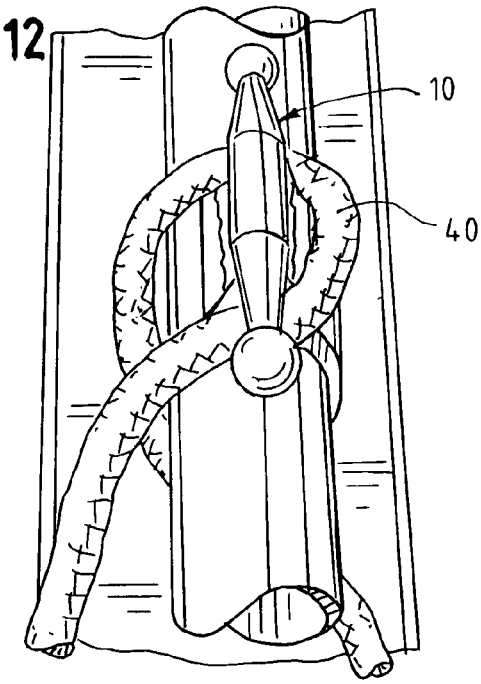
FIG. 12 is an overhead view of the boat cleat of FIG. 1 showing a rope having been tied off as in FIG. 11.

FIGS. 9–12 illustrate a technique for threading, tying off and knotting a rope to boat cleat 10, which is mounted on rail 20. In FIG. 9, rope 40 is first threaded through cleat aperture 12. In FIG. 10, rope 40, having already been threaded through cleat aperture 12, is being tied off to cleat 10. In FIG. 11, rope 40, is fully tied off on cleat 10. FIG. 12 shows rope 40 having been fully tied off to cleat 10 as in FIG. 11.

Figure 13:
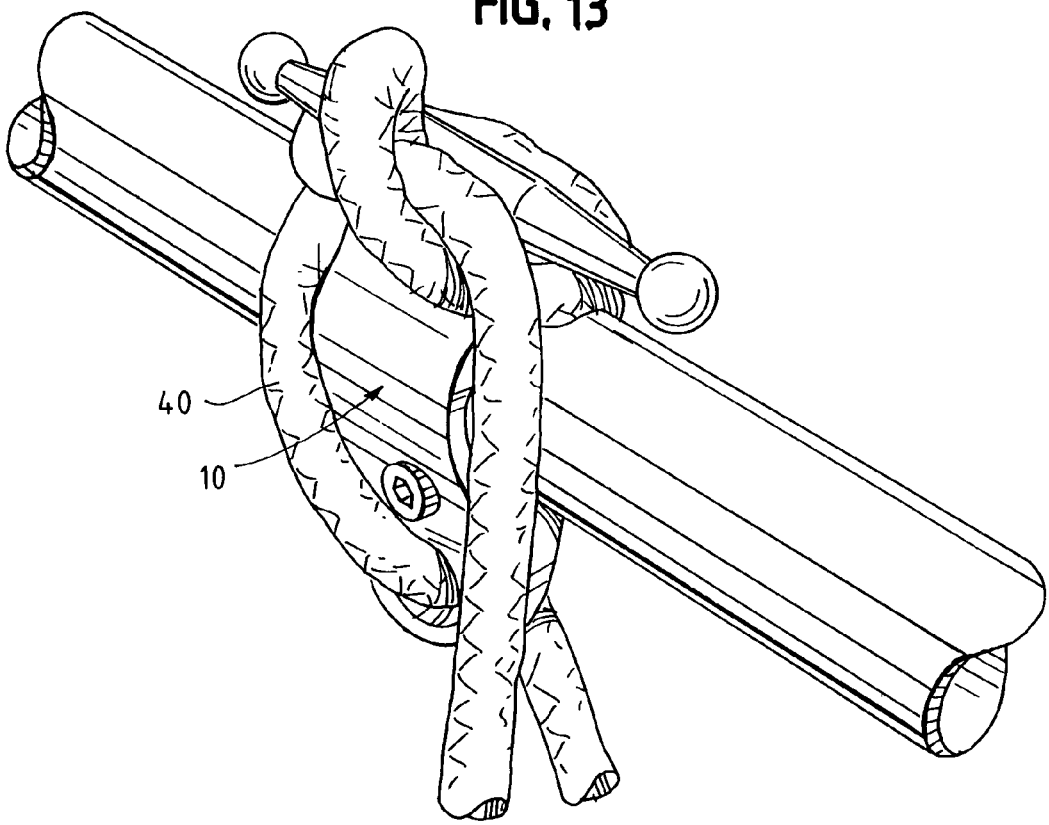
FIG. 13 is a perspective view of the boat cleat of FIG. 1 in which the rope is tied off and knotted around cleat horns.

FIG. 13 shows rope 40 fully tied off and knotted around the horns of cleat 10.

Figure 14:
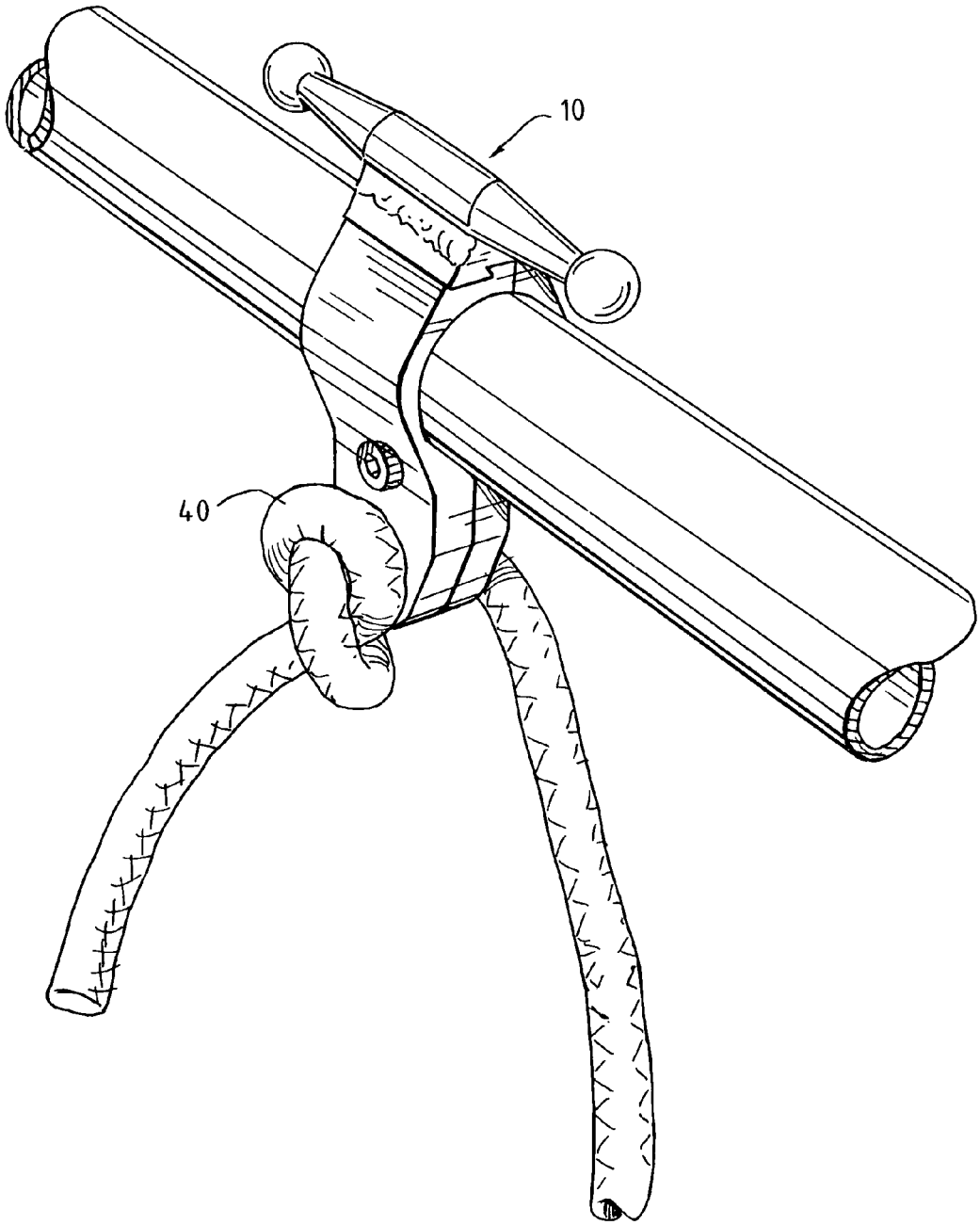
FIG. 14 is a perspective view of the boat cleat of FIG. 1 in which a rope is knotted at the cleat aperture.

FIG. 14 shows rope 40 having been knotted at the aperture (hidden from view in FIG. 14) of cleat 10.

While particular elements, embodiments and applications of the present invention have been shown and described, it will be understood, of course, that the invention is not limited thereto since modifications can be made by those skilled in the art, particularly in light of the foregoing teachings. It is therefore contemplated that the appended claims cover such modifications as incorporate those features that come within the scope of the invention.

What is claimed is:

1. A cleat for securing a rope comprising:

(a) a main component having a first end portion with an aperture formed therein and an oppositely disposed second end portion having at least one cleat horn projecting therefrom, said main component having a connectable surface and a mountable surface; and (b) a secondary component having a first end portion with an aperture formed therein, said secondary component aperture alignable with said main component aperture, said secondary component having a connectable surface and a mountable surface, said secondary component connectable surface adapted to cooperate with said main component connectable surface such that said secondary component is engageable with said main component, said secondary component mountable surface adapted to cooperate with said main component mountable surface such that said cooperating mountable surfaces secure said cleat to a support when assembled, wherein one of said main component connectable surface and said secondary component connectable surface has an outwardly projecting portion, and the other of said main component connectable surface and said secondary component connectable surface has a reciprocally configured channel formed therein for receiving said outwardly projecting portion.

2. The cleat of claim 1 wherein said outwardly projecting portion is key-shaped and said reciprocally configured channel is keyway-shaped.

3. A method for securing a rope to a cleat, the method comprising steps of:

(a) securing the cleat to a support, said cleat comprising a main component and a secondary component, said main component having an aperture formed in a first end portion thereof and at least one cleat horn projecting from an oppositely disposed second end portion thereof, said main component and said secondary component connectable to frictionally secure said cleat to a support when assembled;

(b) threading the rope through said aperture;

(c) tying the rope around said at least one cleat horn.

4. The method of claim 3, wherein the rope when tied around said at least one cleat horn is clenched between said at least one cleat horn and said support.

5. The method of claim 3 further comprising the step of knotting a loose end of the rope.

* * * * *